US005454553A

United States Patent [19]

Firl et al.

[11] Patent Number: 5,454,553

[45] **Date of Patent: * Oct. 3, 1995**

[54] PAPER TRAYS FOR COMPUTER DRIVEN PRINTER

[75] Inventors: Gerold Firl, Downy, by Scott W. Zantow, administrator; Lance Cleveland, San Diego, both of Calif.; Timothy Zantow, deceased, late of Elm Grove, Wis., by Scott W. Zantow, administrator

[73] Assignee: Hewlett-Packard Company, Palo Alto, Calif.

[ * ] Notice: The portion of the term of this patent subsequent to Oct. 11, 2011 has been disclaimed.

[21] Appl. No.: 321,336

[22] Filed: Oct. 11, 1994

Related U.S. Application Data

[62] Division of Ser. No. 55,650, Apr. 30, 1993, Pat. No. 5,354, 044.

[51] Int. Cl.[6] ..... B65H 5/22

[52] U.S. Cl. ..... 271/4.04; 271/126; 271/145; 271/207

[58] Field of Search ..... 271/3, 4, 126, 271/145, 162–164, 207, 209; 211/50, 55; 347/3, 104, 108

[56] References Cited

U.S. PATENT DOCUMENTS

| | | | |
|---|---|---|---|
| 3,510,124 | 5/1970 | Bentzman | 271/162 |
| 4,279,504 | 7/1981 | Brown et al. . | |
| 4,361,319 | 11/1982 | Ikeda et al. | 271/209 |
| 4,728,963 | 3/1988 | Rasmussen et al. | 271/209 |
| 5,152,622 | 10/1992 | Rasmussen et al. | 347/104 |
| 5,323,176 | 6/1994 | Sugiura et al. | 347/101 |

FOREIGN PATENT DOCUMENTS

| | | | |
|---|---|---|---|
| 0237026 | 9/1987 | European Pat. Off. . | |
| 0292094 | 11/1988 | European Pat. Off. . | |
| 0498561 | 8/1992 | European Pat. Off. . | |
| 3431235 | 3/1985 | Germany . | |
| 0110436 | 4/1989 | Japan | 271/162 |
| 49-223964 | 8/1992 | Japan | 271/207 |
| 40-365741 | 12/1992 | Japan | 271/207 |

OTHER PUBLICATIONS

Tubbs, IBM Technical Disclosure Bulletin vol. 26 No. 11, Apr. 1984 Computer Printer Paper Stand, p. 6020.

Klitz, IBM Technical Disclosure Bulletin, vol. 18 No. 4, Sep. 1975, Keyboard Terminal Paper Feeding p. 1014.

*Primary Examiner*—H. Grant Skaggs

[57] ABSTRACT

A computer printer tray system comprising a paper input tray and a paper output tray, neither of which is required to have any moving parts. The output tray is supported in part by the input tray and both trays of the system are semi-permanently cantilever supported from the front of the printer so that neither tray has to be removed when loading an unprinted stack of cut sheet paper or removing printed paper. The output tray has a first portion which is inclined from a second portion by about 10° to correct paper curl caused by a wet printing process.

14 Claims, 9 Drawing Sheets

PAPER TRAYS FOR COMPUTER DRIVEN PRINTER

CROSS REFERENCE TO RELATED APPLICATIONS

This is a divisional of copending application Ser. No. 08/055,650 filed on Apr. 30, 1993, now Pat. No. 5,354,044.

BACKGROUND OF THE INVENTION AND PRIOR ART

The present invention relates to paper input and output trays for computer driven printers, and, more particularly, for inkjet printers.

Inkjet printers have been provided with permanently attached paper input trays which necessarily give the printer a larger footprint during shipping thus requiring larger containers than are required for printers having detachable paper input trays.

Printer paper input and output trays are regularly accessed by the printer operator and may be removable or permanently attached trays. The former are removed from the printer whenever the paper supply is exhausted for refilling with a stack of cut sheet paper. Printers with removable trays occupy a smaller footprint and therefore can be shipped in smaller containers but they have other drawbacks. Removable trays usually have a spring biased pusher plate beneath the paper stack for urging paper upwardly toward the printer feed rollers which remove one sheet at a time from the stack. Repeated removal, loading and reinstallation of the paper tray in the printer is a relatively easy task provided that care is taken to properly remove the tray, load the paper and reinstall the tray. Despite ordinary precautions, through repeated usage, removable paper trays, and the parts thereon such as the pusher plate and particularly the parts thereof that connect the tray to the printer, are subject to wear and eventual breakage.

Similarly, paper output trays are ordinarily easily removable trays which are hung on the front of the printer with plastic hooks or the like which are subject to breakage. Particularly in printers such as inkjet printers which apply print to the paper using wet ink, paper curl which usually takes place about the long center axis of the paper is also a problem.

Accordingly, a semi-permanently attached paper tray system for a printer such as an inkier printer is desired which, after installation by the user, is intended to remain in place on the printer even during paper loading so as to minimize the frequency of tray removal and attendant breakage. Both trays of the system should still be removable when desired without special tools and both trays should be easily accessible, preferably from the front of the printer, whereby paper can be loaded into the input tray without removal of either the paper input tray or the paper output tray. The paper input tray preferably should have no moving parts.

SUMMARY OF THE INVENTION

The present invention provides a computer printer paper tray system comprising: a paper input tray; a paper output tray; and means for supporting said output tray on said input tray cantilevered from a printer; said input tray comprising a generally horizontal paper shelf, a pair of upstanding sidewalls and a front endwall having a portion extending upwardly from said shelf, each of said sidewalls having a cantilevered tray support arm extending rearwardly therefrom, said arms each having an upper edge for supporting said paper output tray and a hook at a free end thereof, at least one of said arms being resilient, each hook being receivable in a pocket in said printer to retain said input tray therein.

DESCRIPTION OF THE PREFERRED EMBODIMENT

Figure 1:
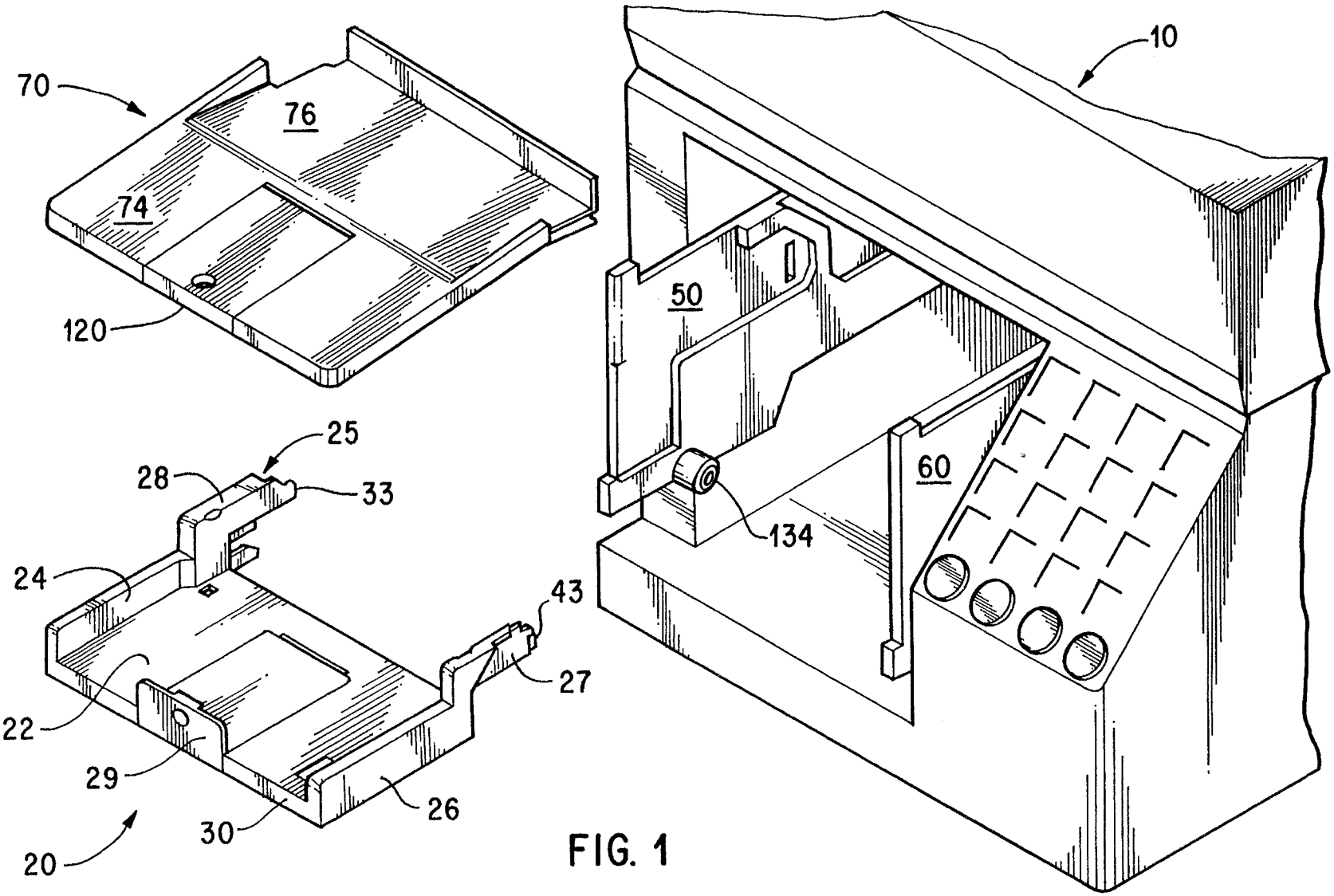
FIG. 1 is an exploded perspective view of a computer driven printer showing the printer chassis with the paper input and paper output trays removed.
Figure 2:
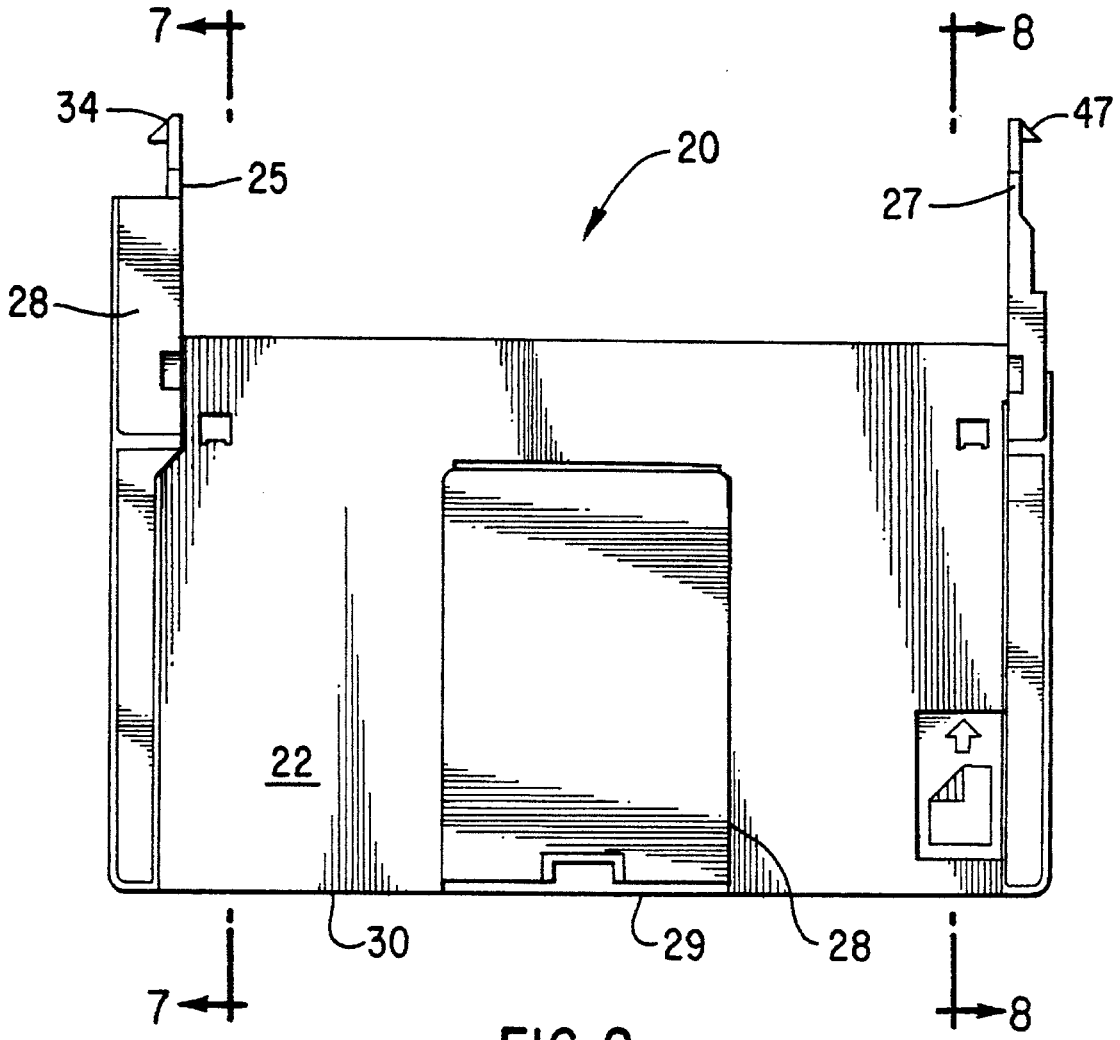
FIG. 2 is a top plan view of the paper input tray.
Figure 3:
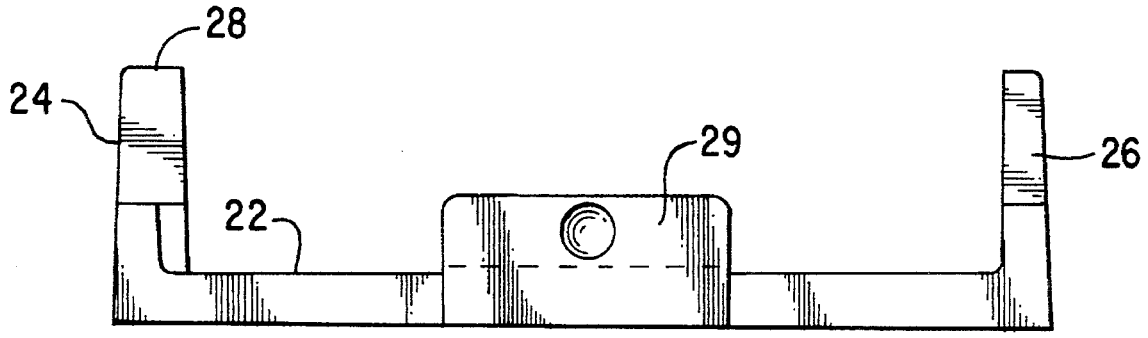
FIG. 3 is a front elevation view of the paper input tray.
Figure 4:
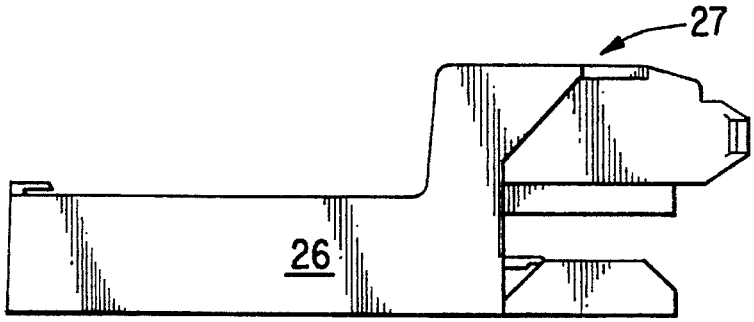
FIG. 4 is right side elevation view of the paper input tray.
Figure 5:
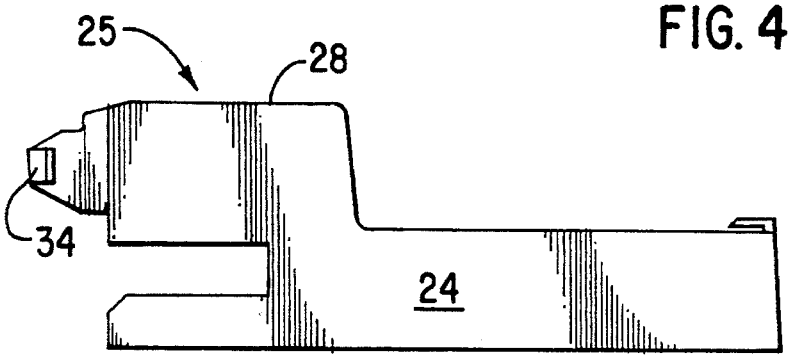
FIG. 5 is a left side elevation view of the paper input tray.

The exploded view of FIG. 1 shows a printer 10, particularly a desk top printer such as an ink jet printer which has a paper input tray 20 and a paper output tray 70 located thereabove. Ordinarily, the paper input tray 20 is first inserted into the printer and is retained therein and suspended from the printer chassis in cantilever fashion on the front of the printer. The paper output tray 70 is installed immediately above the paper input tray and is partially supported thereby. When inserted in the printer, the trays are attached in such a fashion that they are, while removable, not intended to be regularly removed from the printer and in fact the input tray need not be removed from the printer for loading of a fresh supply of paper unlike various prior art paper cassettes or trays which must be removed whenever they are to be reloaded. Accordingly, the paper tray system of the present invention is referred to as a semi-permanently attached paper tray system.

The paper input tray 20 will be described first. The input tray is molded plastic and has a horizontally extending shelf 22 and a pair of integrally molded upstanding sidewalls 24, 26. A paper size adjustment shelf 28 is slidably attached to the front side 30 of the paper input tray and has a front endwall 29 which is adjustably positionable to accommodate different sizes of paper in the tray as is well known.

Each of the sidewalls 24, 26 is in the form of an inverted channel having a rearwardly extending tray support arm 25, 27 which is received in the printer to support the paper input tray 20 in cantilever fashion from the front of the printer chassis. The left side inverted channel tray support arm 25 has an upper horizontally extending web 28 which comprises an output tray support surface. Vertically extending from the upper web 28 is an exterior flange 30 and an interior flange 32. The interior flange portion of the arm 25 extends rearwardly and has an outwardly extending hook 34 at it's free end. The hook has a beveled portion 36 to facilitate insertion of the arm into the printer left hand chassis plate 50 (FIG. 10) and a forwardly facing stop shoulder 38 which engages a rearwardly facing stop shoulder in a pocket 61 in the left hand printer chassis plate 50 to resist removal of the input tray from the printer. The left arm interior flange 32 is laterally resilient so that the hook 34 will move laterally inwardly against the bias of the resilient arm 25 as the beveled surface 36 of the hook 34 engages the left printer chassis plate 50 during insertion of the paper input tray into the printer.

Figure 10:
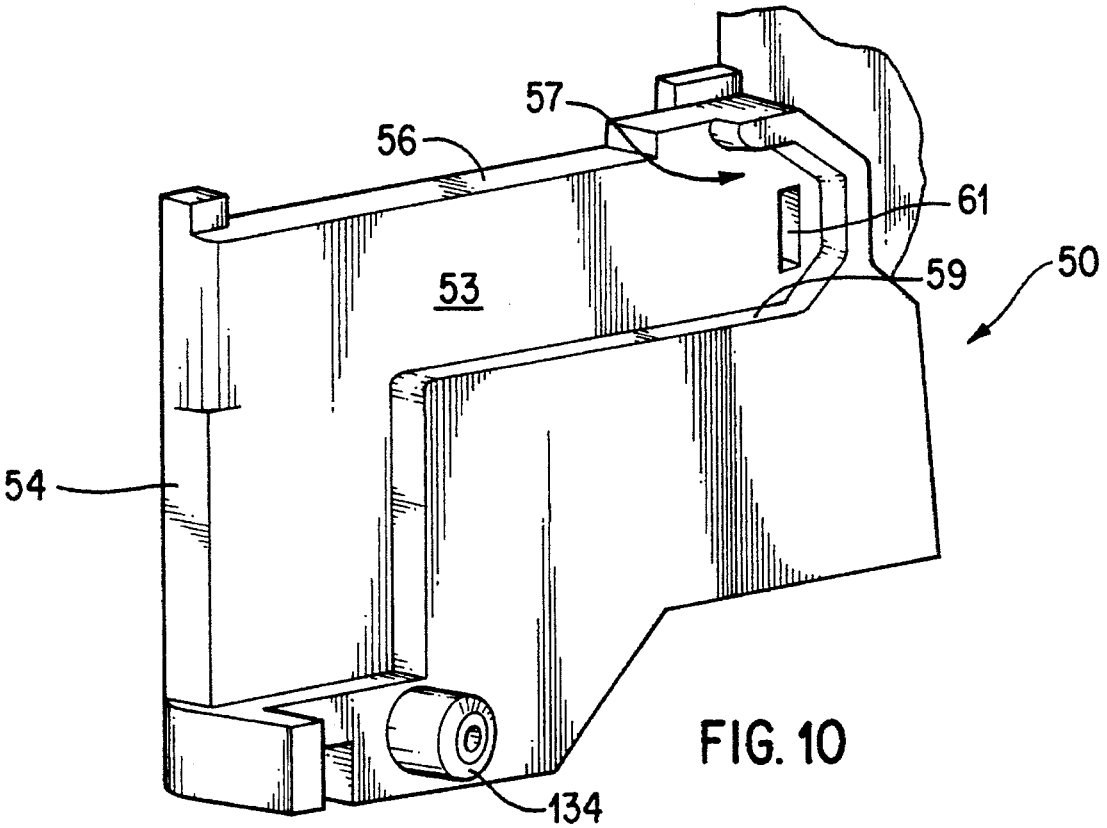
FIG. 10 is a perspective view of the left side chassis plate of the printer.

The right hand arm 27 is also in the form of an inverted channel having a horizontally extending web 40 which comprises an output tray support surface and a pair of vertically extending interior and exterior flanges 42, 44. The interior flange 42 of the right arm also includes a hook 47 and the flange 42 of the right arm 27 is also preferably laterally resilient so that the right hand hook 46 can engage a complementary receiving pocket 62 in the right hand printer chassis plate 60 (FIG. 10). Each of the interior flanges 32, 42 on the left and right arms has a shaped male end 33, 43 to facilitate insertion of the arms into complementary shaped female receiving apertures 53, 63 in the printer chassis plates 50, 60.

Figure 6:
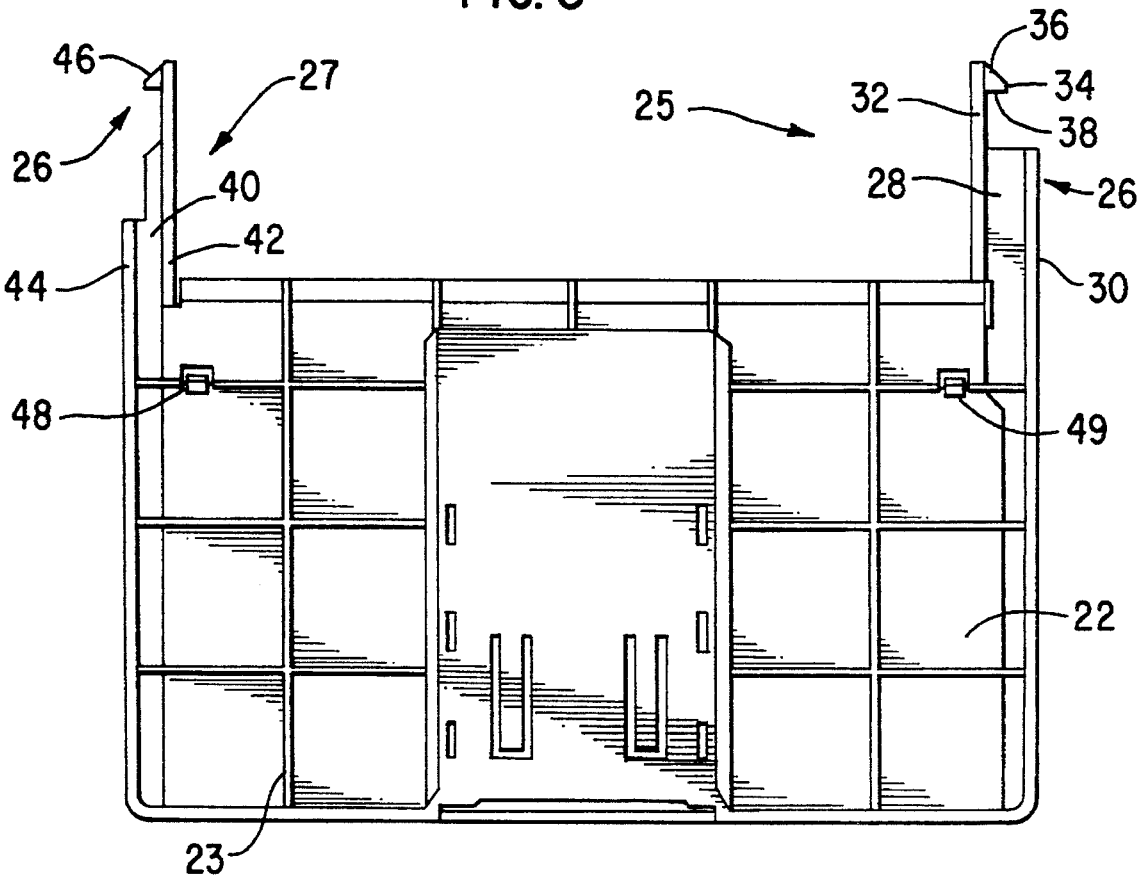
FIG. 6 is a bottom plan view of the paper input tray.
Figure 7:
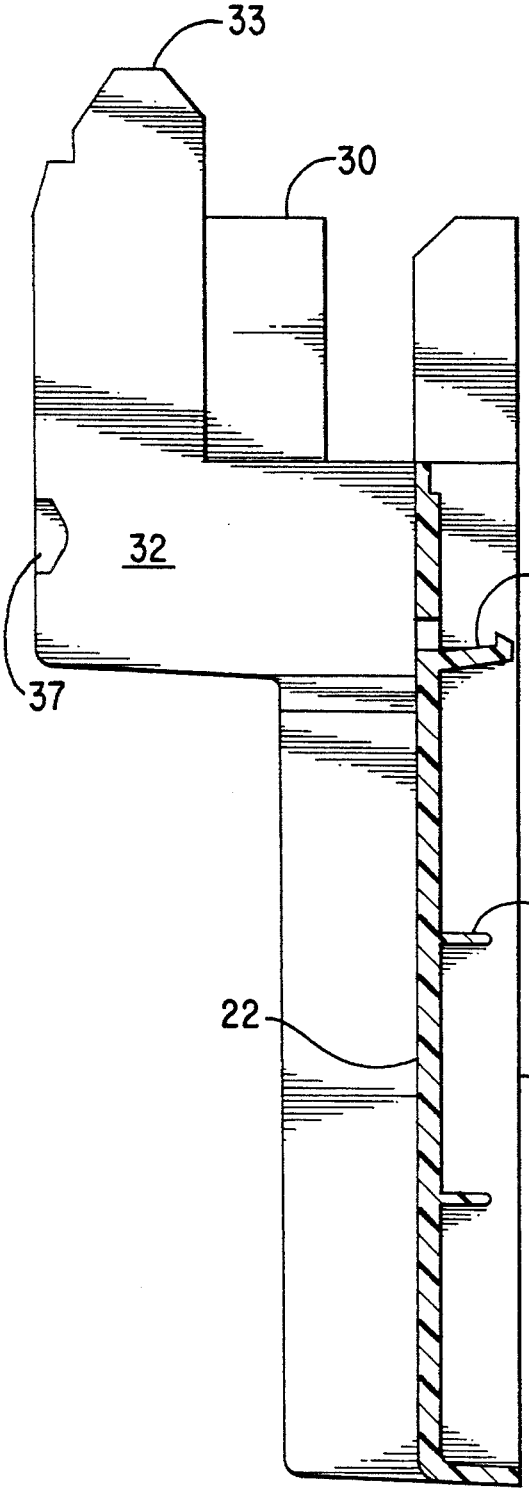
FIG. 7 is a vertical cross section taken at line 7—7 on FIG. 2.
Figure 8:
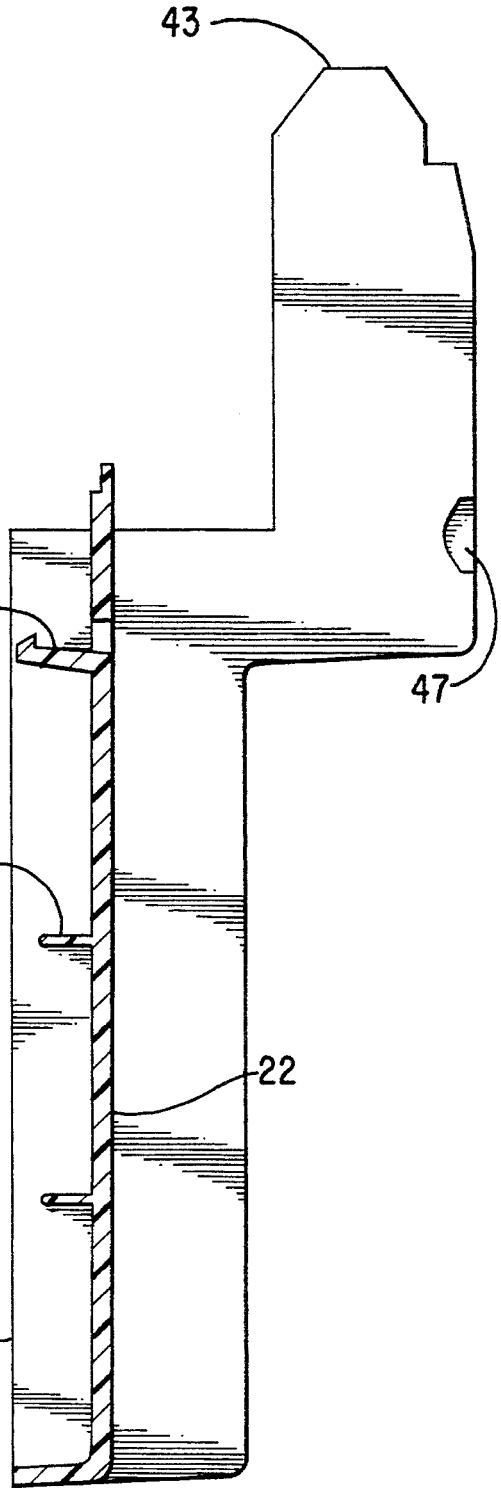
FIG. 8 is a vertical cross section taken at line 8—8 on FIG. 2.

Upwardly facing notches 37, 47 (FIGS. 7 and 8) in the horizontally extending web support surfaces 28, 40 are provided to receive downwardly facing projections on the paper output tray 70 (to be described in more detail below) for properly positioning it above the paper input tray. As seen in FIG. 6, the bottom of the paper shelf 22 is preferably molded with a plurality of criss-cross stiffening webs 23 and a pair of downwardly extending resilient rearwardly facing hooks 48, 49 (also seen in FIGS. 7 and 8) which engage printer chassis structure to resist upward movement of the front edge of the paper tray after it has been fully inserted into the printer.

Figure 9:
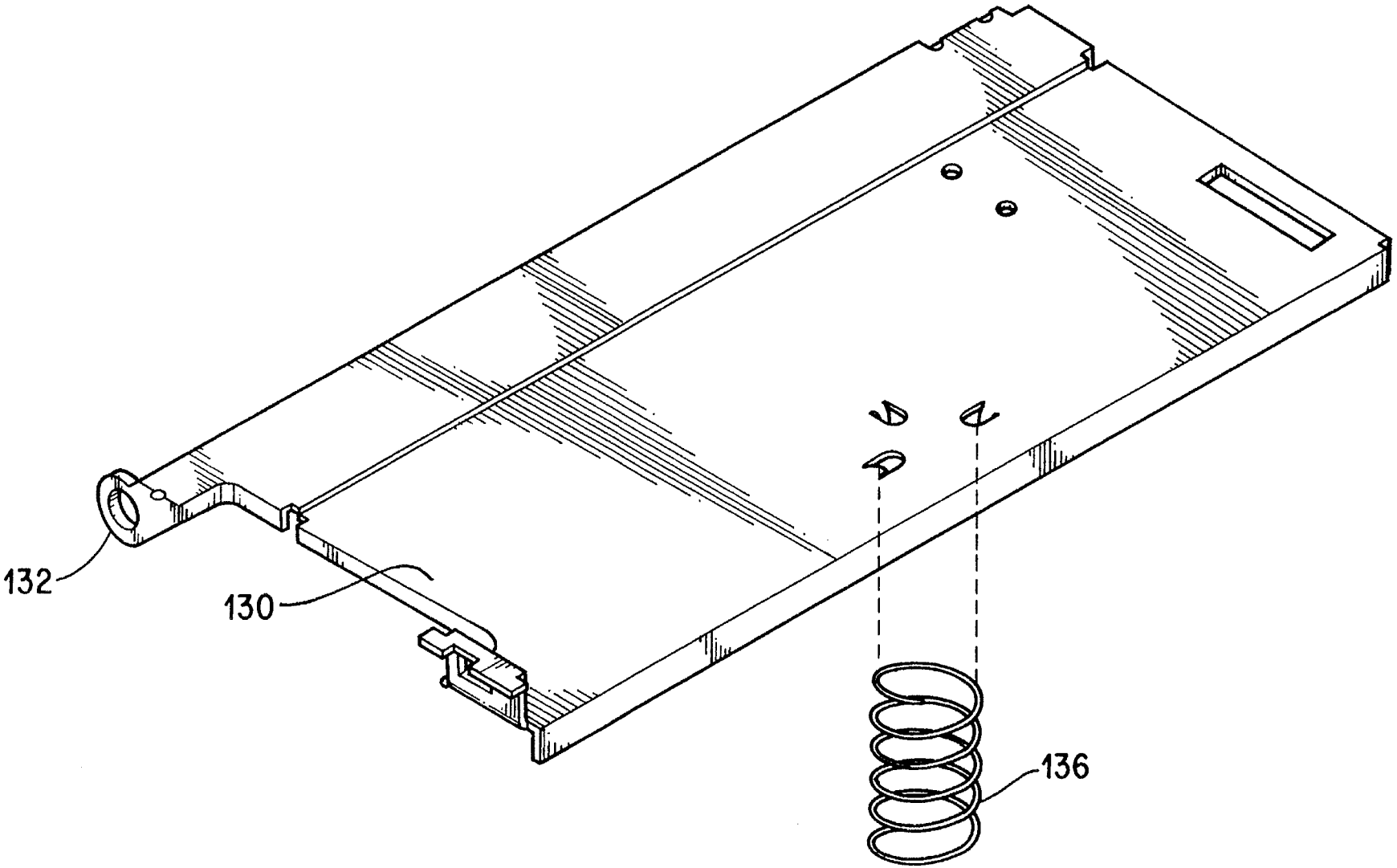
FIG. 9 is a perspective view of a spring biased paper shelf which is pivotally mounted to the printer chassis proximate the paper input tray.
Figure 11:
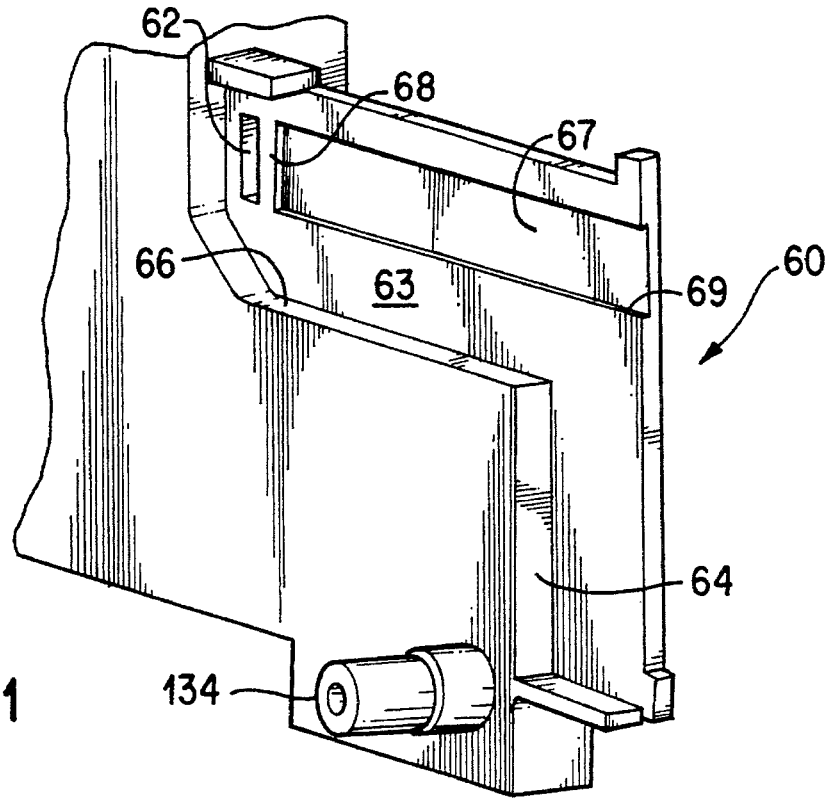
FIG. 11 is a perspective view of the right side chassis plate of the printer.
Figure 12:
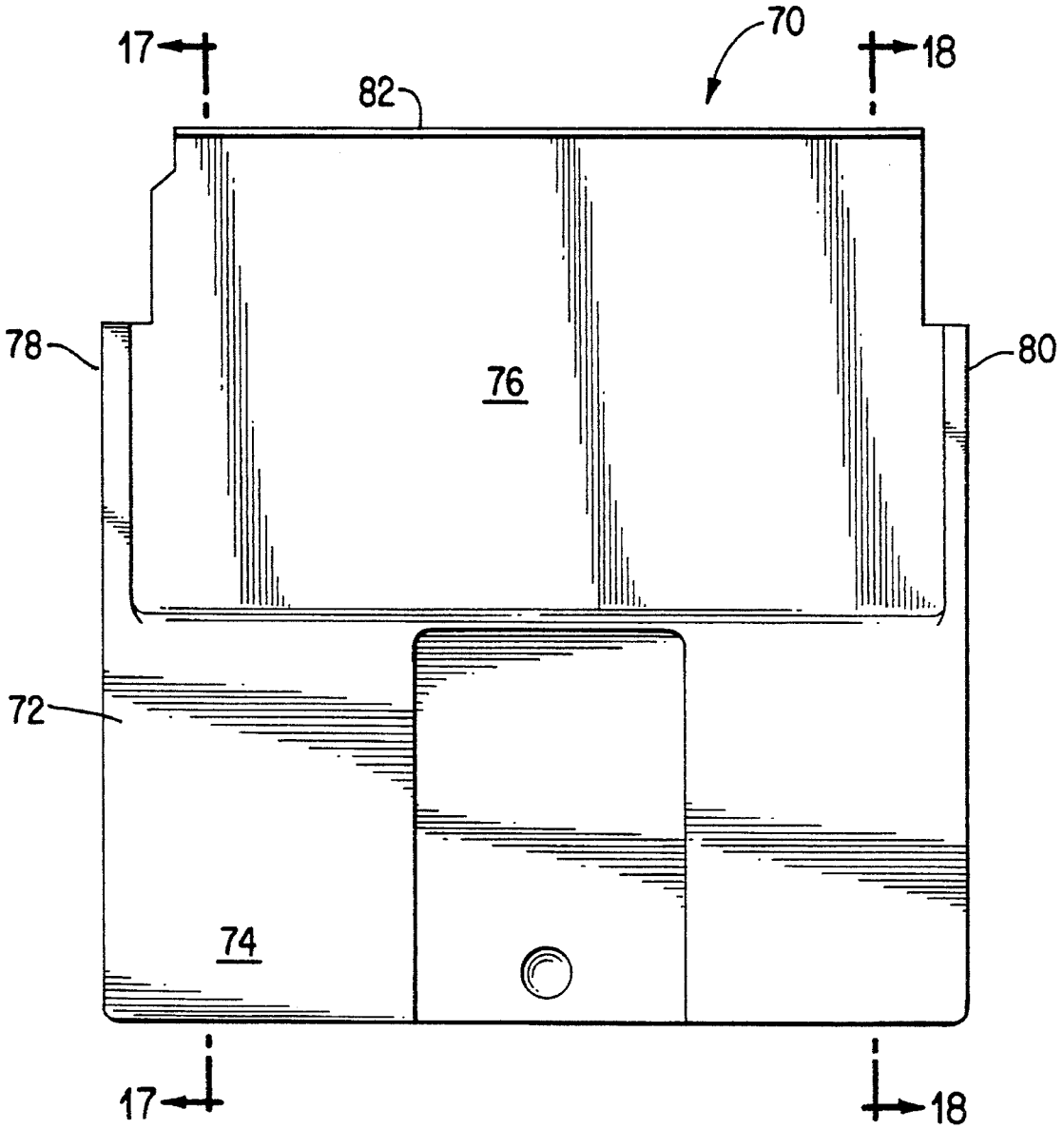
FIG. 12 is a top plan view of the paper output tray.
Figure 13:
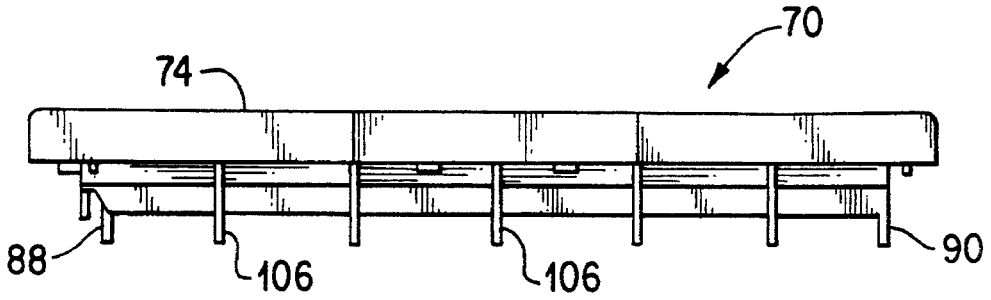
FIG. 13 is a front elevation view of the paper output tray.
Figure 14:
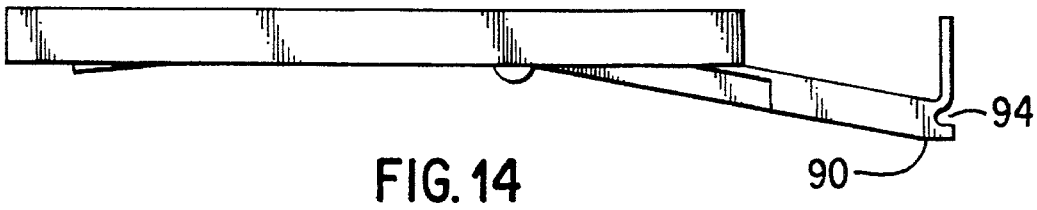
FIG. 14 is right side elevation view of the paper output tray.
Figure 15:
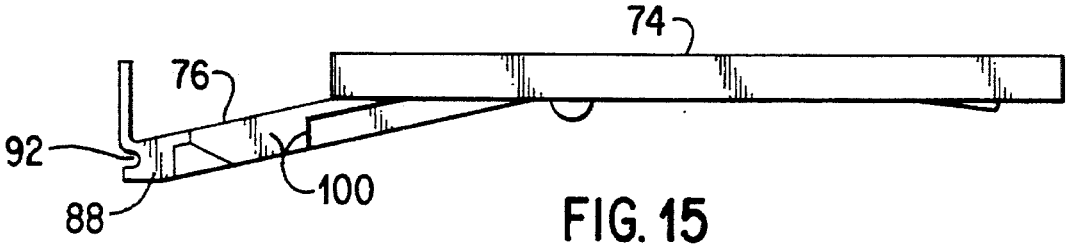
FIG. 15 is a left side elevation view of the paper output tray.

FIG. 9 schematically shows a pivotally mounted spring biased paper shelf 130 having a pair of ears 132 at the front corners thereof which are received on opposed horizontally extending half axles 134 which extend from the left and right chassis plates 50, 60 of the printer (FIGS. 1, 10 and 11). The lower end of compression spring 136 seats against the printer chassis and pushes the underside of the rear portion of the shelf 130 upwardly. When a stack of paper is loaded onto the paper input tray, the front portion of the paper rests on the shelf 130 so that the leading edges of the paper sheets are biased upwardly toward paper pick rollers, not seen.

FIGS. 10 and 11 respectively comprise perspective views of the left and right chassis plates 50, 60 of the printer which preferably comprise molded plastic vertically extending plates each having a front endwall 54, 64 and a generally horizontally extending interior female shelf 56, 66 which receives the male arms 25, 27 of the paper input tray 20. The beveled camming surfaces on the hooks 34, 36 on the interior ends of the arms are received in horizontally extending recesses 57, 67 in the side chassis plates until the hooks engage a beveled surfaces 58, 68 at the ends of the recesses 57, 67 which urges the resilient arms 25, 27 inwardly toward each other so that the hooks can enter retaining pockets 61, 62 in the chassis plates 50, 60. The lower edges of the flanges 30, 32; 42, 44 of the arms 25, 27 are thus supported on upwardly facing surfaces 59, 69 of the female recesses 57, 67 and the endwalls 54, 64 of the chassis side plates substantially engage vertically extending edges 55, 65 of the vertically extending exterior and interior flanges 30, 32; 42, 44 of the paper input tray arms.

Figure 16:
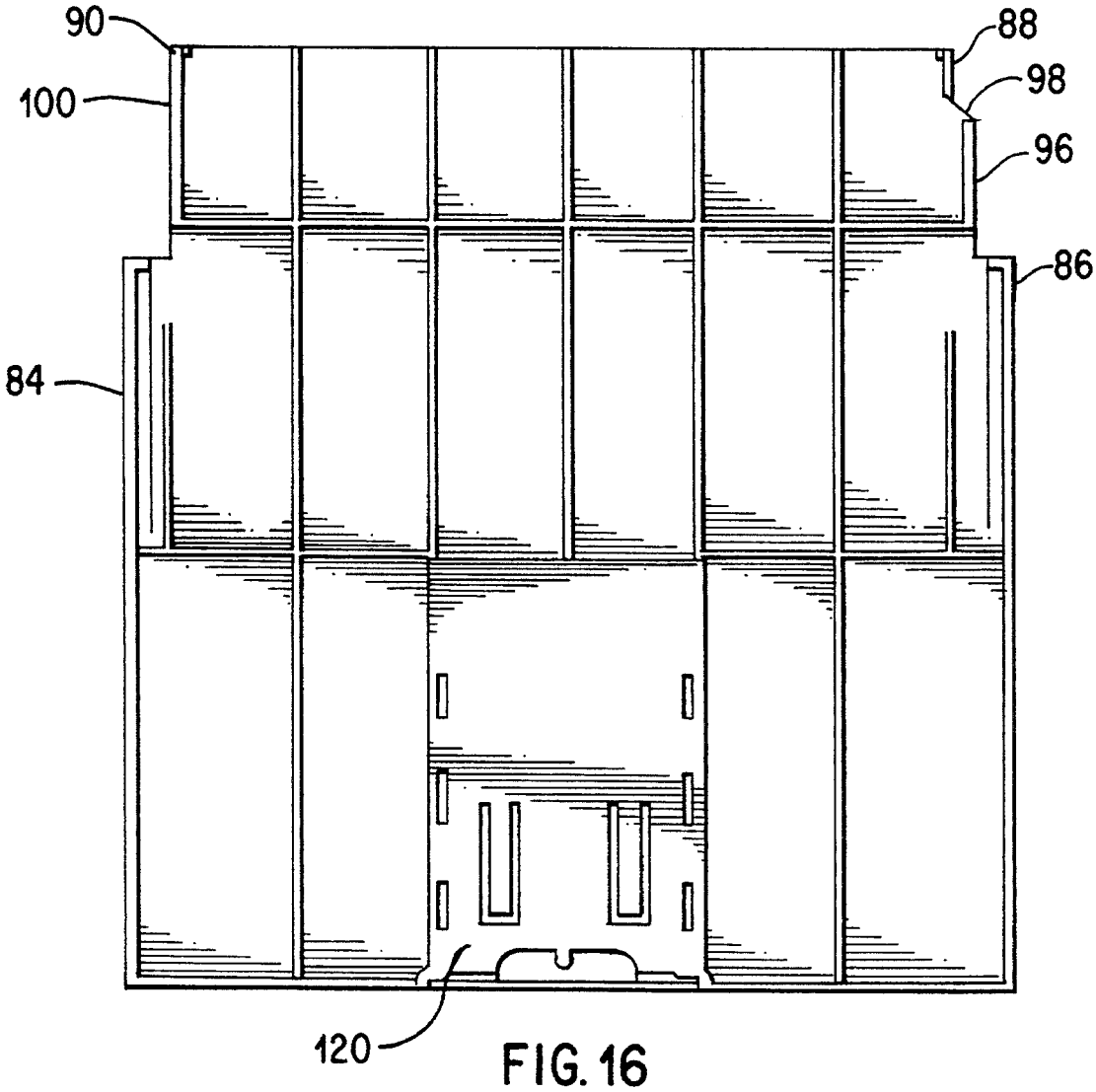
FIG. 16 is a bottom plan view of the paper output tray.

The paper output tray 70 comprises a molded plastic shelf 72 having a front horizontal portion 74 and a rear portion 76 which is downwardly inclined from the front portion at an angle of about 10°. The downwardly inclined rear portion 76 includes a pair of upwardly extending sidewalls 78, 80 and a rear endwall 82 which is received in the printer. The rear inclined portion 76 of the shelf has a pair of downwardly extending flanges 84, 86 at the lateral edges thereof and a pair of guide ears 88, 90 at the lateral edges of the rear inclined portion. Each ear has a rearwardly open general horizontally extending elongated slot 92, 94 therein which engages a retaining pin which extends inwardly from each of the side chassis plates 50, 60 in the printer. The bottom plan view of FIG. 16 shows that the ear 88 and one lateral edge 96 of the inclined portion (the right edge as seen in FIG. 16) is inwardly offset from the marginal flange 86 of the front portion of the tray and has an inclined camming surface 98 which assists in centering the tray in the printer during installation thereof by engaging a correspondingly beveled surface on the left hand printer chassis sideplate 60. The output tray 70 also has a rearwardly and forwardly extending guide wing 100 depending downwardly from the undersurface of the rear portion 76 proximate the left side edge thereof. The wing 100 has a rearwardly and upwardly extending guide surface 102 and a forwardly and upwardly extending guide surface 104 which respectively engage the left hand printer chassis plate 50 to lift the left hand tray edge during attachment to and removal of the tray 70 from the printer. When properly positioned, the paper output tray wing 100 is received in a pocket in the left hand printer chassis plate such that the front portion of the tray is properly oriented horizontally.

Figure 17:
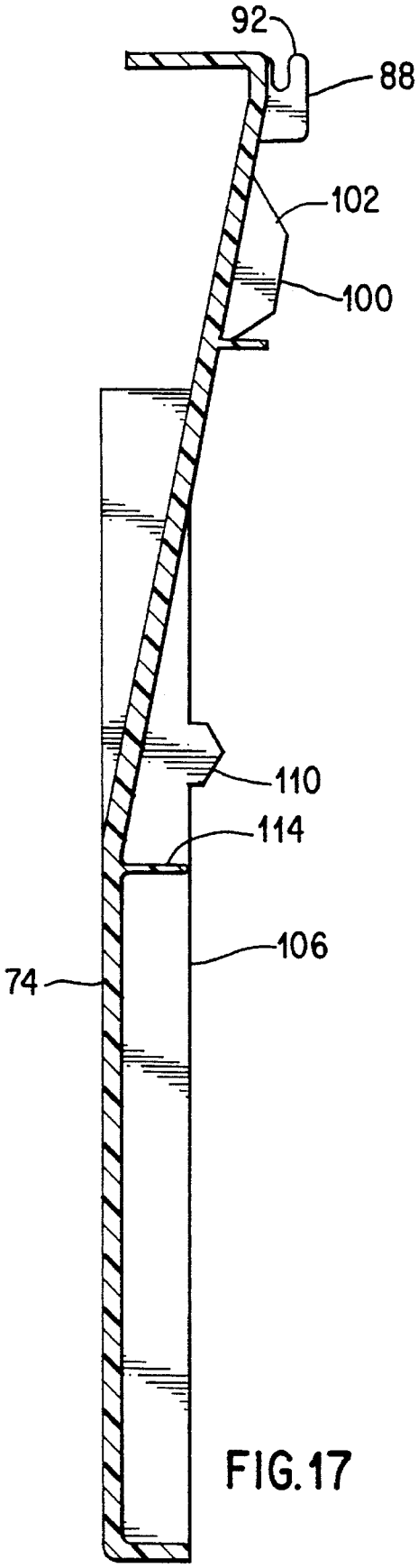
FIG. 17 is a vertical cross section taken at line 17—17 on FIG. 12.
Figure 18:
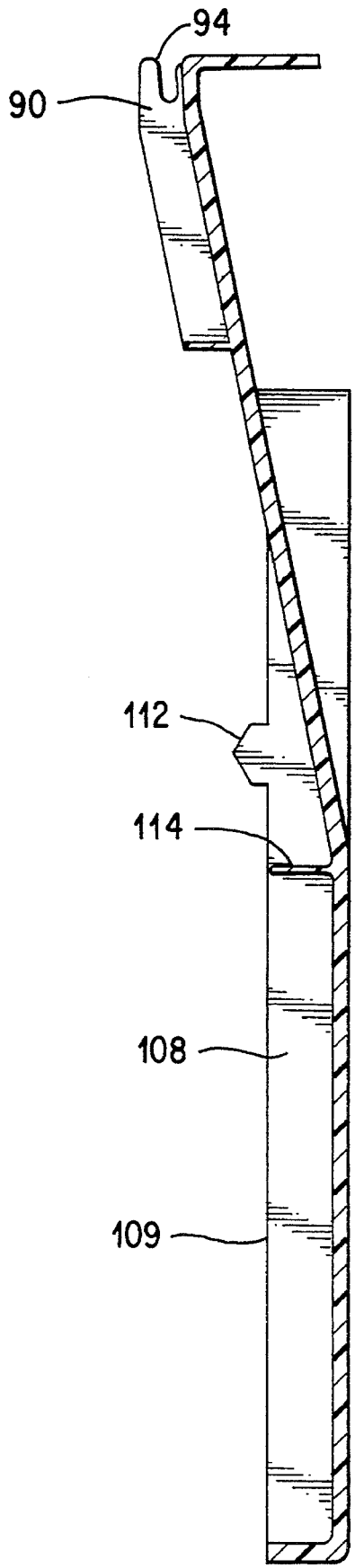
FIG. 18 is a vertical cross section taken at line 18—18 on FIG. 12.

FIGS. 17 and 18 show vertically extending webs 106, 108 integrally molded on the underside of the output tray whose lower edges 107, 109 define horizontally extending output tray support surfaces which engage the horizontally extending web support surfaces 28, 40 on the printer input tray arms 25, 27. Downwardly facing projections 110, 112 on the output tray support surfaces are received in the previously described upwardly facing notches 37, 47 on the paper input tray web support surfaces. A plurality of vertically extending stiffening webs 114 is also shown on the underside of the horizontal and inclined surfaces of the paper output tray which also has a sliding shelf 120 to accommodate paper of different lengths.

The tray system thus far described, but not the spring biased paper shelf 130, is disassembled from the printer during shipment and, upon installation in the printer, the paper input tray 20 is first inserted with the hooks 34, 46 snapping into place in their respective pockets 61, 62 in the printer chassis and with the lower hooks 48, 49 engaging printer structure to resist upward movement of the front edge of the paper input tray. The laterally resilient arms 25, 27 of the paper input tray firmly resist removal of the tray from the printer under ordinary conditions but are sufficiently resilient to allow them to be manually bent toward each other for tray removal when desired.

The paper output tray 70 is next inserted into the printer such that the ears 88, 90 and slots 92, 94 engage the pins in the printer at which time the downwardly extending projections 110, 112 are aligned with the notches 37, 47 in the paper input tray so that the paper output tray is supported in the printer and on the paper output tray. Inclination of the rear portion 76 of the paper output tray at an angle of about 10° with respect to the horizontal portion 74 of the output tray reduces paper curl along the longitudinal axis of the paper which typically occurs in wet process printers such as ink jet printers. This paper curl about the long axis is automatically straightened in the present output tray because the printed paper bends about the line of intersection between the horizontal portion of the tray and the inclined portion of the tray as it is deposited thereon.

The present tray system occupies a small footprint in the shipping container and is also user friendly since the user need not remove the tray from the printer when loading paper therein nor manually straighten curl in the printed paper.

Persons skilled in the art will readily appreciate that various modifications can be made from the preferred embodiment thus the scope of protection is intended to be defined only by the limitations of the appended claims.

We claim:

1. A printer system comprising:

a chassis member;

an input tray for holding a plurality of media sheets, said input tray being removable from said chassis member during non-use of the printing system, such as during shipment;

an output tray mounted above said input tray and on the same side of said chassis member as said input tray for receiving a printed media sheet, said output tray being removable from said chassis member during non-use such as during shipment; and mounting means for mounting said input tray and said output tray on said chassis member during use of the printer system, said mounting means including a pair of elongated cantilever arms on said input tray and elongated receiving apertures on said chassis for slidably receiving said arms, at least one of said arms being laterally resilient, with said input tray being manually accessible for loading an unprinted stack of media sheets without having to remove said input tray or said output tray from said chassis member.

2. The printing system of claim 1, with said output tray being manually accessible for removing a printed sheet without having to remove said input tray or said output tray.

3. The printing system of claim 1 wherein said output tray is partially supported by said input tray.

4. The printing system of claim 1 wherein said chassis member is part of an inkjet printer.

5. The printing system of claim 1 which further includes a movable shelf member on said chassis member and aligned with said input tray when said input tray is removably mounted on said chassis member, said shelf member being biased upwardly and positioned to underlay an end portion of said media sheets in said input tray to facilitate individual media sheets being picked from a stack in said input tray.

6. A method of storage and use of input and output trays for an inkjet printer system, comprising the following steps:

removably mounting the input tray on a printer by slidably engaging cantilever arms extending from said input tray with receiving apertures in a printer chassis while laterally deforming at least one of said arms, so that the input tray can be removed from the printer during shipment, and so that the input tray can remain in mounted position on the printer during operation of the printer as well as during reloading of media into the input tray; and removably mounting the output tray above said input tray on the printer and extending laterally from the same side of the printer, so that the output tray can be removed from the printer during shipment, and so that the output tray can remain in mounted position on the printer during operation of the printer as well as during reloading of media into the input tray.

7. The method of claim 6, which further includes the steps of aligning the input tray so that a forward portion of media sheets stacked in the input tray rest on a movable shelf on the printer; and biasing the movable shelf upwardly to facilitate the printer picking individual sheets from the input tray.

8. A printer system comprising:

a chassis member defining a media path for media traveling in a given direction from an entrance to an exit;

an input tray having a pair of elongated cantilever arms thereon, at least one arm being laterally resilient, said input tray being mounted on said chassis member with said arms slidably received in apertures in said chassis to be in communication with said entrance, for holding sheets of media to be printed;

an output tray having first and second end portions and mounted on said chassis member above said input tray and on the same side of said chassis member with said first end portion in communication with said exit and said second end portion being manually accessible for removing a printed sheet, said first end portion including a media support surface inclined in said given direction at an angle relative to said second end portion to prevent any media curl caused by the printer system.

9. The printer system of claim 8 wherein said media support surface is inclined downwardly at an angle relative to said second end portion.

10. The printer system of claim 9 wherein said second end portion is positioned to be substantially horizontal.

11. The printer system of claim 8 wherein said media support surface is inclined at an angle less than forty-five degrees relative to said second end portion.

12. The printer system of claim 8 wherein said media support surface is inclined at an angle less that twenty degrees relative to said second end portion.

13. The printer system of claim 8 wherein said media support surface is inclined at an angle of approximately ten degrees relative to said second end portion.

14. The printer system of claim 8 wherein said printer system includes a liquid ink printer.

* * * * *